United States Patent [19]

Hara

[11] Patent Number: 4,792,237

[45] Date of Patent: Dec. 20, 1988

[54] AGITATING BLADE STRUCTURE OF SOIL STABILIZING APPARATUS

[76] Inventor: Mituo Hara, 3-9, 1-chome, Miyako-machi, Oita-shi, Japan

[21] Appl. No.: 938,697

[22] Filed: Dec. 5, 1986

[51] Int. Cl.[4] ..... B01F 7/16; B28C 5/08

[52] U.S. Cl. ..... 366/296; 366/65; 366/169; 366/349; 175/19

[58] Field of Search ..... 366/296, 293, 292, 279, 366/13, 56, 64–67, 169, 170, 342, 349; 166/285, 286; 175/19, 21; 106/288 R, 900

[56] References Cited

U.S. PATENT DOCUMENTS

| | | | |
|---|---|---|---|
| 361,186 | 4/1887 | Ritchey | 366/296 |
| 936,410 | 10/1909 | Chase et al. | 366/296 |
| 948,214 | 2/1910 | Fisher | 366/296 |
| 1,437,567 | 12/1922 | Stewart | 366/296 |
| 1,577,615 | 3/1926 | Emery | 366/296 |
| 1,987,700 | 1/1935 | Muir | 366/296 |
| 2,807,447 | 9/1957 | Vanghan | 366/296 |
| 3,363,688 | 1/1968 | Bielstein | 166/285 |
| 4,377,419 | 3/1983 | Reed | 106/900 |
| 4,438,813 | 3/1984 | Nikolaev et al. | 166/285 |

*Primary Examiner*—Harvey C. Hornsby
*Assistant Examiner*—Joseph S. Machuga
*Attorney, Agent, or Firm*—Jordan and Hamburg

[57] ABSTRACT

An agitating and cutting blade structure of soil apparatus substantially comprises a plurality of concentric rotary shafts which rotate in mutually opposite directions and a plurality of agitating blades which are fixedly mounted on the respective rotary shafts and rotate in opposite directions corresponding to the rotation of the rotary shafts as well as a cutting blade fixed to the free end of one of the rotary shafts. Due to such construction, the soil receives a complicated and strong shearing force, is vigorously agitated and mixed with hardening agent efficiently hardened.

6 Claims, 8 Drawing Sheets

AGITATING BLADE STRUCTURE OF SOIL STABILIZING APPARATUS

The present invention relates to an agitating blade structure of soil stabilizing apparatus.

BACKGROUND OF THE INVENTION

Conventionally, for stabilizing the extremely soft soil, an upright or vertical hole is formed in the soil using a digging device mounted on a base machine and the soil dug by the digging device is agitated and mixed with a hardening agent so as to harden and thereby stabilize the soil.

In the above soil stabilizing operation, the soil agitation and mixing operation is carried out by agitating bars or the like which are fixedly mounted on a rotary shaft or an auger of the drilling device.

In such agitating structure, however, since all the agitating bars rotate along with the rotary shaft, the soil dug by the agitating structure also rotates along with the rotating shaft in the same direction so that the soil cannot be agitated sufficiently.

Especially in a soil stabilizing operation using a powdery hardening agent in and made of extremely soft soil such as muddy soil which contains a considerable amount of water, the soil dug by the agitating structure adheres around the agitating bars and forms a spherical soil ball and the soil agitating and mixing operation becomes entirely impossible.

SUMMARY OF THE INVENTION

Accordingly, it is an object of the present invention to provide an agitating blade structure of soil stabilizing apparatus which can resolve the above defects of the conventional agitating structure and can assure an extremely efficient agitating and mixing operation even for extremely soft soil.

It is another object of the present invention to provide an agitating blade structure of soil stabilizing apparatus which can be inexpensively manufactured.

In summary, the present invention discloses an agitating blade structure f soil stabilizing apparatus which comprises a plurality of concentric rotary shafts each of which rotates in a direction opposite to the next and a plurality of agitating blades which are fixedly mounted on the respective rotary shafts and rotate in opposite directions corresponding to the rotation of the rotary shafts.

DETAILED DESCRIPTION OF THE PREFERRED EMBODIMENTS

First Embodiment

Figure 1:
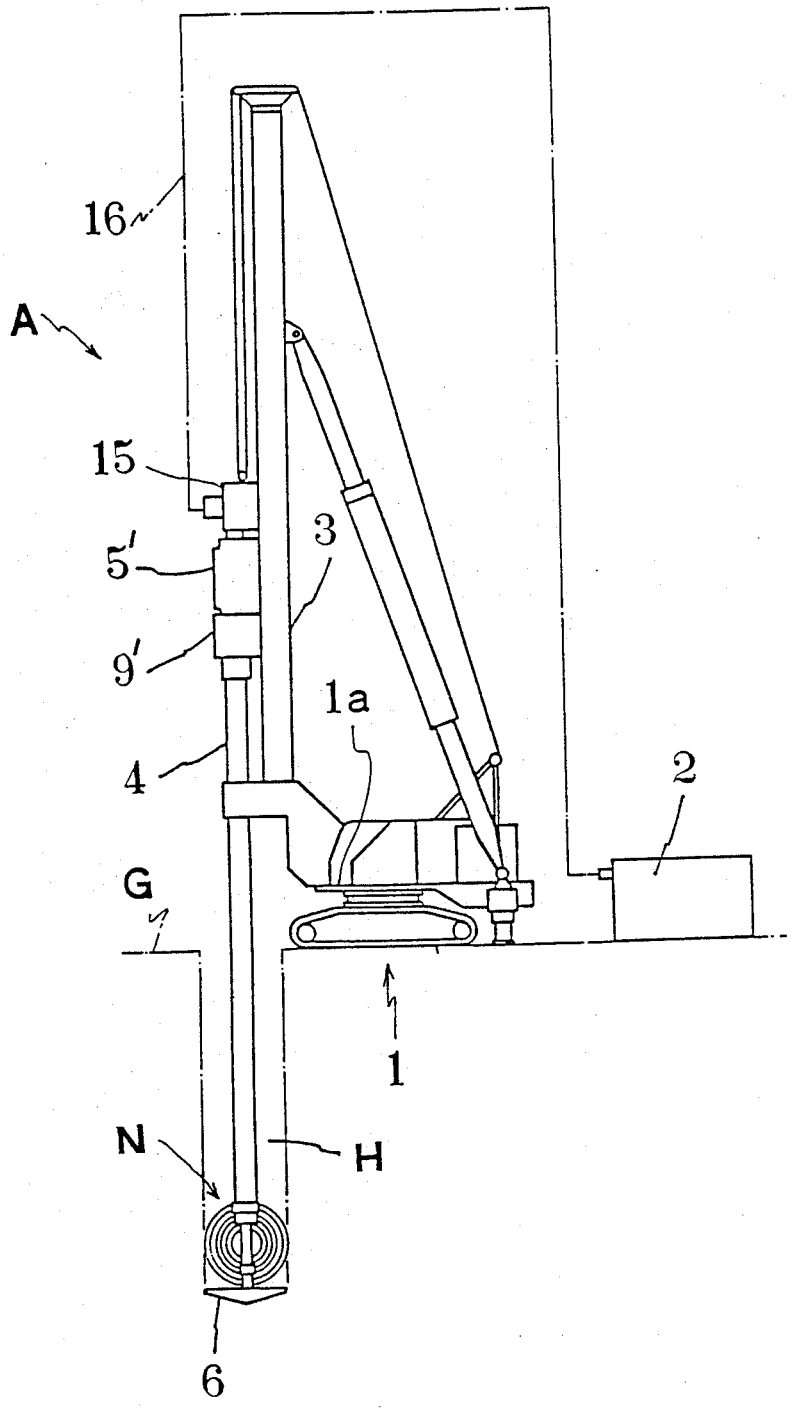
FIG. 1 is a side elevational view of a soil stabilizing apparatus equipped with an agitating blade structure of the first embodiment of the present invention.

In FIG. 1, a soil stabilizing apparatus A provided with an agitating blade structure of the present invention is shown in the elevational view.

The soil stabilizing apparatus A substantially comprises a movable or transportable base machine 1 and a hardening agent storage tank 2.

The base machine 1 comprises a leader 3 which is mounted on a turntable 1*a* of the base machine 1 in an upright manner, a rotary shaft 4 which is rotatably and elevatably supported on and along the leader 3 and hydraulic motor 5' together with gear box 9' mounted on the upper end of the leader 3 so as to rotate the rotary shaft 4 and a cutting blade 6.

Due to such construction, when the cutting blade 6 is driven and is lowered along the leader 3, a vertical hole H is formed in the ground G.

Figure 2:
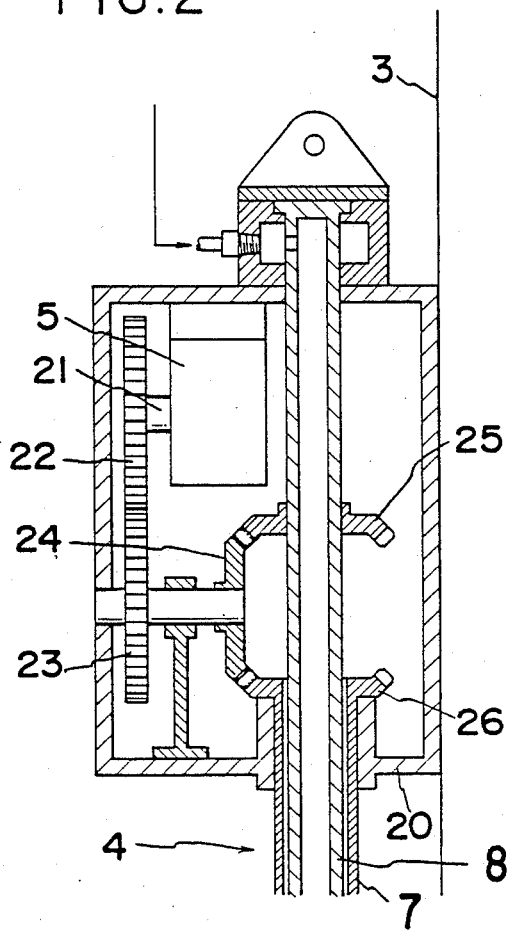
FIG. 2 is an enlarged longitudinal cross sectional view of another embodiment of a shaft driving mechanism suitable for use in a soil improving apparatus of the general type illustrated in FIG. 1.

As shown in FIG. 2, the rotary shaft 4 has a concentric double tube construction made of outer and inner shafts 7 and 8 and these shafts 7,8 rotate in opposite directions relative to each other by a hydraulic motor 5 which, in this embodiment, is encased together with a gear train at the upper end of the rotary shaft 4.

The cutting blade 6 for drilling purpose is fixedly attached to the extremity of the inner shaft 8.

In FIG. 2, 20 indicates a slide casing which is slidably mounted on the leader 3. The casing 20 accomodates the hydraulic motor 5 therein and an output shaft 21 thereof is operatively connected with the outer and inner shafts 7,8 by way of gears 22, 23, 24, 25 and 26.

Due to such construction, when the hydraulic motor 5 is driven in one rotating direction, the outer and inner shafts 7, 8 which are secured to the bevel gears 26,25 respectively are rotated in opposite directions relative to each other.

Figure 3:
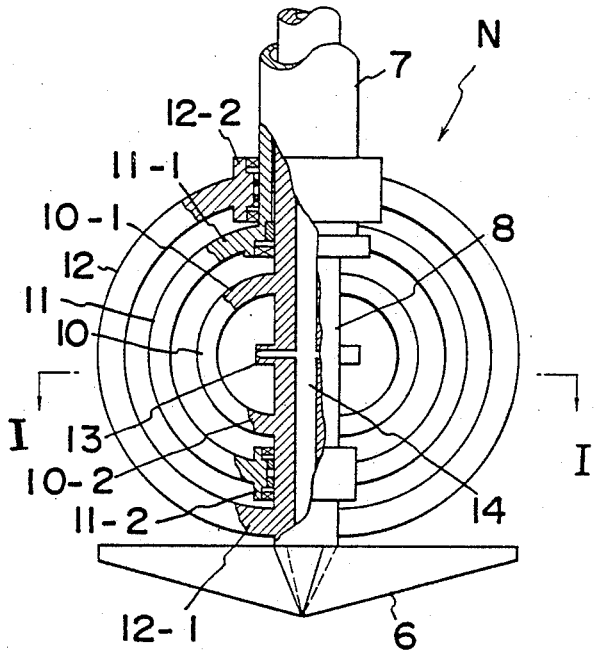
FIG. 3 is an enlarged front view with a part broken away of the agitating blade structure of the first embodiment.
Figure 4:
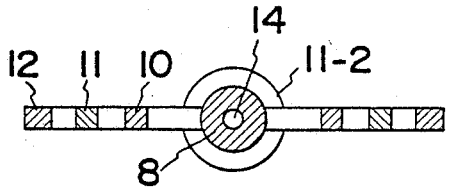
FIG. 4 is a transverse cross sectional view of the agitating blade structure taken along the line I—I of FIG. 3.

As shown in FIG. 1, FIG. 3 and FIG. 4, at a position above the cutting blade 6 of the rotary shaft 4, an agitating mechanism N is mounted on the rotary shaft 4.

The agitating mechanism N consists of three symmetrically arranged pairs of inner, intermediate and outer agitating blades 10,11 and 12.

The inner agitating blade 10 has a semi-circular elevational view and has the upper and lower ends thereof 10-1, 10-2 are fixedly secured to the outer surface of the inner rotary shaft 8. The intermediate agitating blade 11 has the upper end 11-1 thereof secured to the outer surface of the outer shaft 7 and the lower end thereof rotatably supported on the outer surface of the inner shaft 8 by way of an intermediate bearing 11-2. The outer agitating blade 12 has the lower end 12-1 thereof fixedly secured to the outer surface of the inner shaft 8 and the upper end thereof rotatably supported on the outer surface of the outer shaft 7 by way of an outer bearing 12-2.

Due to such construction, when the outer shaft 7 and the inner shaft 8 are rotated in opposite directions relative to each other by means of the hydraulic motor 5, the intermediate agitating blade 11 rotates between the inner and outer agitating blades 10 and 12 and also in a direction opposite to the rotating direction of the outer and inner agitating blades 10 and 11.

Accordingly, the soil disposed in an imaginary spherical space defined by the loci of the rotating radial tip ends of the agitating blades 10,11 and 12 receives a strong and complicated shearing action so that the soil is vigorously agitated and mixed. Especially, the phenomenon that the soil rotates together with the rotary shaft 4 and adheres to the rotary shaft 4 like a mass or clod can be completely eliminated.

In this manner, the soil is efficiently agitated and mixed by the agitating structure N of the present invention.

Referring now to a mechanism for ejecting a soil hardening agent into the soil around the agitating structure, 13 indicates a hardening agent ejecting nozzle which is fixedly mounted on the outer surface of the inner shaft 8 at a location between the upper and lower ends 10-1 and 10-2 of the inner agitating blade 10.

The hardening agent ejecting nozzle 13 extends horizontally to the ground G or perpendicular to the axis of the rotary shaft 4 and communicates with a vertical hollow passage 14 formed in the inner shaft 8 and the vertical hollow passage 14 communicates with the hardening agent supply tank 2 mounted on the ground G by way of a swivel joint 15 mounted on the upper end of the rotary shaft 4 and a hose 16 as shown in FIG. 1.

The manner in which the above-mentioned agitating structure is operated is hereinafter disclosed in conjunction with the relevant drawings.

For effecting the soil stabilizing operation, the hydraulic motor 5 is driven so as to rotate the rotary shaft 4 and the cutting blade 6 and they are lowered by actuating a winch means mounted on the turntable 1*a* of the base machine 1.

Due to such operation, a vertical hole H of a circular cross section is formed in the ground G. The soil is, however, not discharged or expelled from the vertical hole H so that the cutting blade 6 and the agitating structure N are embedded in the soil dug by the cutting blade 6 and the agitating structure N.

When the cutting blade 6 reaches a predetermined depth, the lowering of the rotary shaft 4 is stopped and the soil hardening agent fed from the hardening agent tank 2 is ejected from the hardening agent ejecting nozzle 13 into the soil and the soil and the hardening agent are agitated and mixed together by the agitating structure N.

Subsequently, while maintaining the ejection of the hardening agent into the soil around the agitating structure N and the agitation and mixing of the soil and the hardening agent, the rotary shaft 4 is elevated gradually so as to improve the soil confined in and around the vertical hole H.

Especially, in the agitating and mixing operation of the soil and hardening agent, since the inner and outer agitating blades 10,12 rotate in a direction opposed to the rotating direction of the intermediate agitating blade 11, the soil disposed in spaces between the inner and intermediate blades 10 and 11 or between the intermediate and outer blades 11 and 12 receives a shearing force as well as the rotating force of these blades 10, 11 and 12 so that the soil and the hardening agent are both vigorously and uniformly agitated and mixed and the rotation of the soil around the agitating structure N along with the structure N can be completely prevented so that the soil is efficiently hardened.

Furthermore, in the soil stabilizing operation in land made of an extremely soft soil such as a muddy soil which contains a considerable amount of water, hardening agent in the form of powder is preferable.

In the present invention, since the agitating blades 6 rotate in opposite directions relative to each other, the generation of a spherical soil ball is completely prevented and the agitating and mixing of the soil are vigorously effected.

The powdery hardening agent is floated in an air flow by a pneumatic powder transport method and flows in a tube along with the air flow and finally is ejected from the hardening agent ejecting nozzle.

Figure 5:
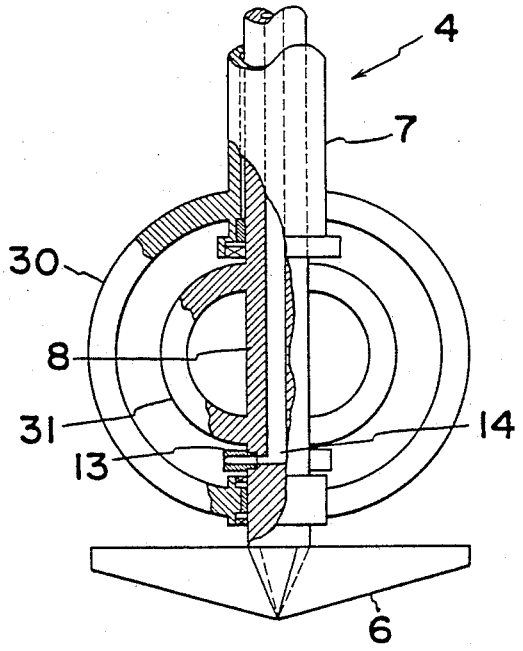
FIG. 5 is an enlarged front view with a part broken away of a modified agitating blade structure of the first embodiment.

In FIG. 5 to FIG. 11, several modifications of the agitating blade structure N of the present invention are disclosed, In the modification shown in FIG. 5, the agitating mechanism N includes only a pair of inner and outer agitating blades 30, 31 which rotate in opposite rotating directions relative to each other.

Figure 6:
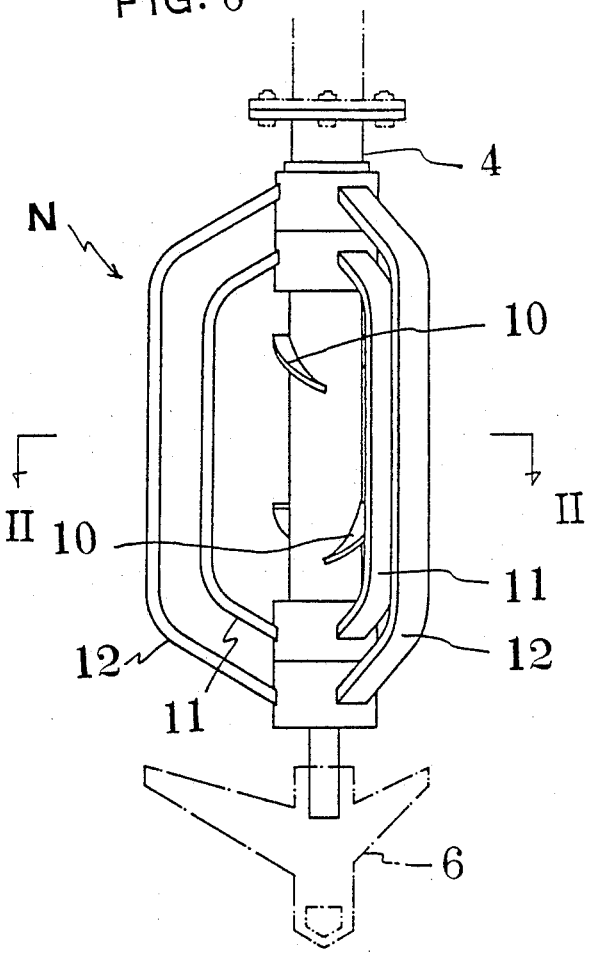
FIG. 6 is an enlarged front view of another modified agitating blade structure of the first embodiment.
Figure 7:
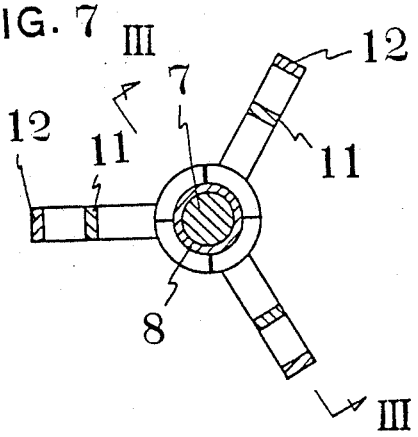
FIG. 7 is a transverse cross sectional view of the agitating blade structure taken along the line II—II of FIG. 6.
Figure 8:
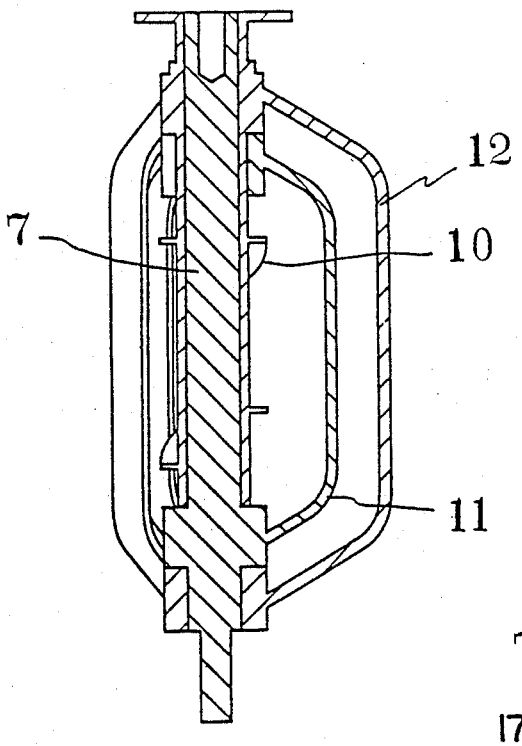
FIG. 8 is a longitudinal cross sectional view of the agitating blade structure taken along the line III—III of FIG. 7.

In the modification shown in FIG. 6 to FIG. 8, the agitating blade 10 is made of a plurality of intermittent blade pieces of a short length and narrow width and the agitating blades 11 or 12 is made of a straight vertical portion a and upper and lower inclined portions b and c.

In this modification, however, the inner shaft 8 is a solid body and has no vertical passage therein for feeding the hardening agent.

Figure 9:
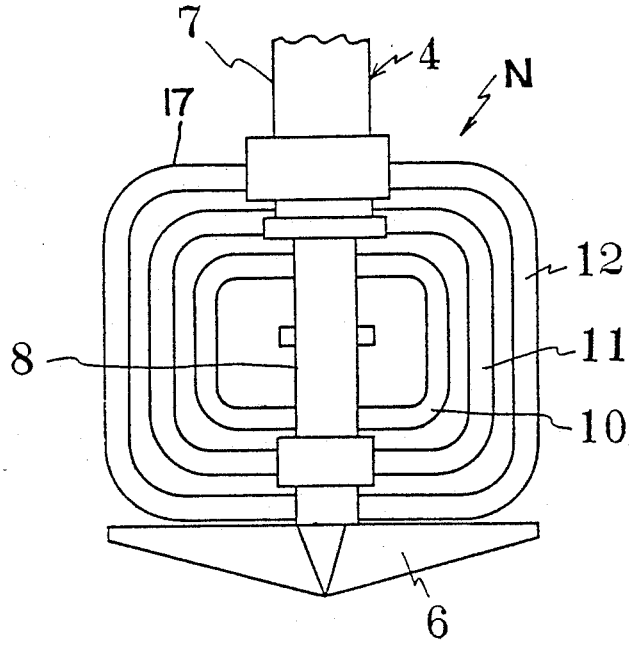
FIG. 9 to FIG. 11 are enlarged front views of still other modifications of the agitating blade structure of the first embodiment.

In the modification shown in FIG. 9, the agitating blades 10, 11 and 12 have a rectangular shape.

Figure 10:
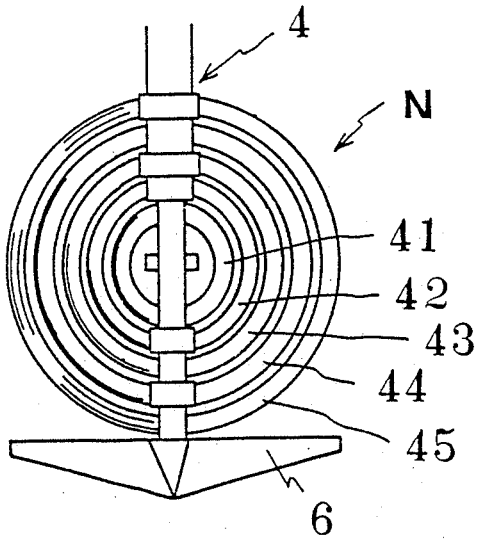

In the modification shown in FIG. 10, the agitating blades 41,42,43,44 and 45 have a circular shape.

Figure 11:
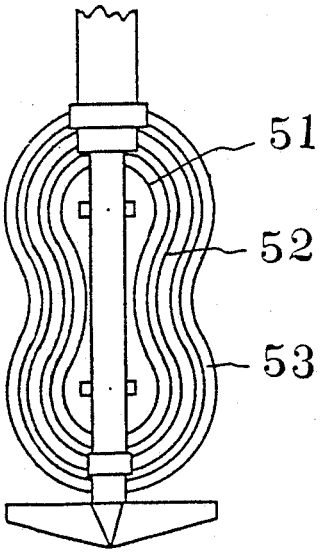

In the modification shown in FIG. 11, the agitating blades 51,52 and 53 have a shape made of a pair of circular portions merged by a central neck portion.

Second Embodiment

Figure 12:
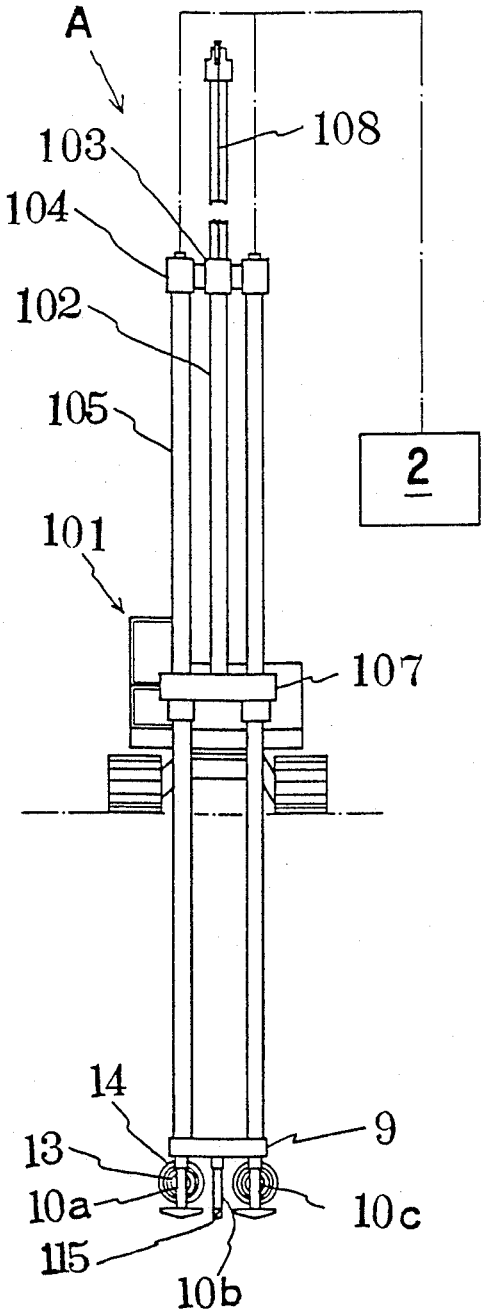
FIG. 12 is a side elevational view of a soil stabilizing apparatus equipped with an agitating blade structure of the second embodiment of the present invention.
Figure 13:
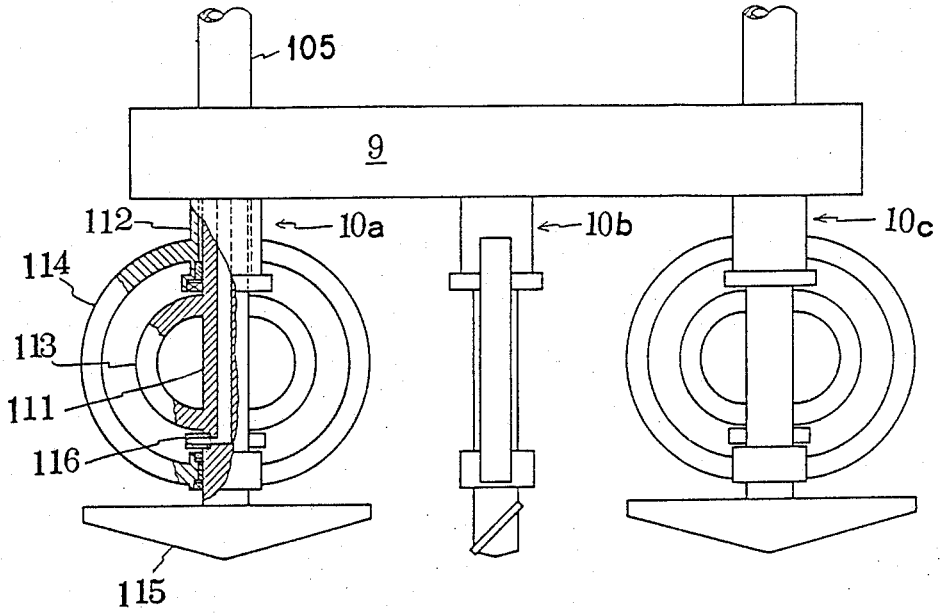
FIG. 13 is an enlarged front view with a part broken away of the agitating blade structure of the second embodiment.
Figure 14:
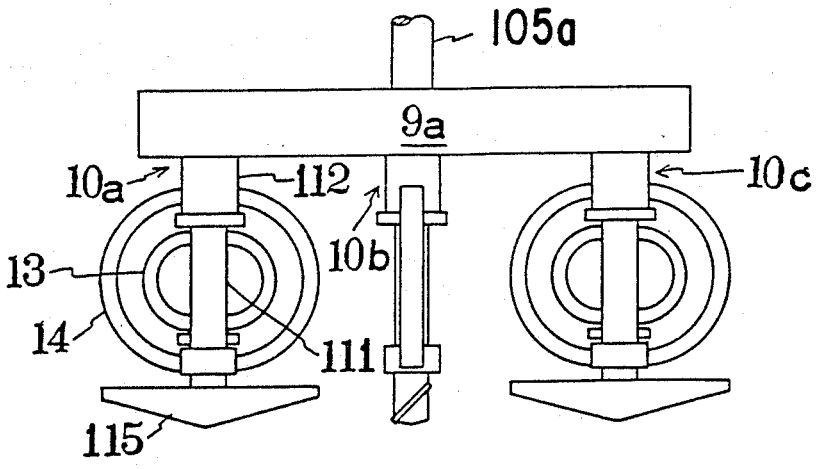
FIG. 14 is an enlarged front view of a modified agitating blade structure of the second embodiment.

The second embodiment is explained in detail in conjunction with FIG. 12 to FIG. 14.

In FIG. 12; A indicates a soil stabilizing apparatus which comprises a movable transportable base machine 101, a leader 102 mounted on the base machine 101 vertically, a slider 103 which is elevatably mounted on the leader 102, a motor 104 which is mounted on the slider 103, and a rotary shaft 105 which has the upper end thereof connected to the motor 104.

Due to such construction, the motor 104 is driven by a power source (not shown) so as to rotate the rotary shaft 105.

In FIG. 12, 107 indicates a guide block which rotatably supports the middle portion of the rotary shaft 105 and prevents lateral swinging or oscillation of the rotary shaft 105.

The rotary shaft 105 is elevated or lowered by a wire 108 which is extended between the slider 103 and the top of the leader 102.

A gear box 9 is connected to the lower end of the rotary shaft 105 and three drilling shafts 10*a*, 10*b*, 10*c* extend downwardly from the lower surface of the gear box 9 in a in parallel spaced apart manner.

Each of the drilling shafts 10*a*, 10*b*, 10*c* has a concentric tubular construction made of inner and outer shafts 111 and 112.

The gear train within the gear box 9 is arranged so that the rotary torque of the rotary shaft 105 is transmitted to all drilling shafts 10*a*, 10*b*, 10*c* and the inner and outer shafts 111 and 112 are rotated in opposite directions.

Inner and outer agitating blades 113,114 are connected to the inner and outer shafts 111 and 112 respectively and the blades 113,114 rotate together with the inner and outer shafts 111 and 112.

A cutting blade 115 is fixedly secured to the extremity of the respective inner shafts 111 of the drilling shafts 10*a*, 10*b*, 10*c*.

116 indicates a hardening agent ejecting nozzle.

The manner in which the above-mentioned agitating structure is operated is hereinafter disclosed in conjunction with the relevant drawings.

For effecting the soil stabilizing operation, the hydraulic motor 104 is driven so as to rotate the rotary shafts 105 and the cutting blade 115 and they are lowered by actuating a winch means mounted on the base machine 101.

When the cutting blade 115 reaches a predetermined depth, the lowering of the rotary shafts 105 is stopped and the soil hardening agent fed from the hardening agent tank 2 is ejected from the hardening agent ejecting nozzle 116 into the soil and the soil and the hardening agent are agitated and mixed together by the agitating structure.

Subsequently, while maintaining the ejection of the hardening agent into the soil around the agitating structure N and the agitation and mixing of the soil and the hardening agent, the rotary shafts 105 are elevated gradually so as to improve the soil confined in and around a vertical hole.

In the above agitating and mixing operation, although each of the drilling shafts 10*a*, 10*b*, 10*c* is subjected to a considerable reaction torque, such reaction torques are offset by the rotations of the inner and outer shafts 111 and 112 which rotate in opposite directions from each other. Furthermore, the gear box 109 has an elongated rectangular surface of a considerably large area which comes into contact with the soil in the vertical hole.

Accordingly, the rotation of the gear box is completely prevented and in each of the drilling shafts there is mutually reverse rotation by the inner and outer shafts 111 and 112.

FIG. 14 shows a modification of the second embodiment where a single rotary shaft 105*a* is connected to the gear box 109 and the rotating torque of the respective drilling shafts 10*a*, 10*b*, 10*c* are all distributed from this rotary shaft 105*a*.

I claim:

1. In a soil stabilizing apparatus, improved means for drilling and agitating soil comprising, (a) a plurality of concentric rotary shafts adapted to be positioned substantially vertically to the ground surface and comprising an inner rotary shaft and an outer rotary shaft, (b) means for rotating said inner and outer rotary shafts in opposite directions relative to each other, (c) a plurality of agitating blades concentrically mounted on said rotary shafts, said agitating blades comprising a first agitating blade which is fixedly secured to the inner rotary shaft and a second agitating blade which is fixedly secured to the outer rotary shaft, said first agitating blade and said second agitating blade being rotatable in opposite directions relative to each other corresponding to the rotation of said inner and outer rotary shafts, the locus of rotation of one of the agitating blades being radially outside the locus of rotation of the other agitating blade, and (d) a cutting blade disposed below said agitating blades, said cutting blade being connected to the bottom end of said inner rotary shaft for rotation with said inner rotary shaft.

2. In a soil stabilizing apparatus, improved means for drilling and agitating soil according to claim 6, wherein said outer rotary shaft is a hollow cylindrical shaft and said inner rotary shaft passes through said outer rotary shaft, a lower end of said inner rotary shaft protrudes downwardly from a lower end of said outer rotary shaft, said first agitating blade has a lower end connected to said lower end of said inner rotary shaft and an upper end spaced apart from said outer rotary shaft, and said second agitating blade has an upper end connected to said lower end of said outer rotary shaft and a lower end spaced apart from said inner rotary shaft, and the locus of rotation of said first agitating blade is radially outside the locus of rotation of said second agitating blade.

3. In a soil stabilizing apparatus, improved means for drilling and agitating soil according to claim 2, further comprising a third agitating blade which is fixedly secured to said inner rotary shaft so a sto be rotated in the same direction as said first agitating blade and wherein said third agitating blade has a locus of rotation radially within the locus of rotation of said second agitating blade.

4. In a soil stabilizing apparatus, improved means for drilling and agitating soil according to claim 6, further comprising means for feeding a hardening agent into the vicinity of the agitating blades.

5. In a soil stabilizing apparatus, improved means for drilling and agitating soil according to claim 2, further comprising means for feeding a hardening agent into the vicinity of the agitating blades.

6. In a soil stabilizing apparatus, improved means for drilling and agitating soil according to claim 1, further comprising means for feeding a hardening agent into the vicinity of the agitating blades.

* * * * *